US008968519B2

(12) United States Patent
Raines et al.

(10) Patent No.: US 8,968,519 B2
(45) Date of Patent: Mar. 3, 2015

(54) SHEET EDGE TRIMMING AND REMOVAL FROM A STRUCTURED PAPER FABRIC

(71) Applicant: Georgia-Pacific Consumer Products LP, Atlanta, GA (US)

(72) Inventors: David Drew Raines, Stone Mountain, GA (US); Farminder Singh Anand, Appleton, WI (US); Theodore D. Kennedy, San Mateo, FL (US); David S. Veldhuizen, Green Bay, WI (US); Mark S. Hunter, Green Bay, WI (US); Dean J. Baumgartner, Cecil, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 14/173,403

(22) Filed: Feb. 5, 2014

(65) Prior Publication Data

US 2014/0262094 A1 Sep. 18, 2014

Related U.S. Application Data

(60) Provisional application No. 61/789,747, filed on Mar. 15, 2013, provisional application No. 61/785,284, filed on Mar. 14, 2013.

(51) Int. Cl.
*B26D 1/00* (2006.01)

(52) U.S. Cl.
USPC ..... 162/286; 162/189

(58) Field of Classification Search
USPC ..... 162/286, 189
See application file for complete search history.

(56) References Cited

U.S. PATENT DOCUMENTS

| | | | |
|---|---|---|---|
| 1,949,188 | A | 11/1960 | Smith |
| 3,200,685 | A | 8/1965 | Heilbrunn |
| 3,252,366 | A | 5/1966 | Karr |
| 3,405,031 | A | 10/1968 | Bryant |
| 3,556,936 | A | 1/1971 | Keiji |
| 3,642,554 | A | 2/1972 | Hensley |
| 3,871,290 | A | 3/1975 | Verboom |
| 4,154,648 | A | 5/1979 | Osterberg et al. |
| 4,231,272 | A | 11/1980 | Crouse |
| 4,242,934 | A | 1/1981 | Coburn |
| 4,329,893 | A | 5/1982 | Wong |
| 4,410,315 | A | 10/1983 | Frye |
| 4,456,502 | A | 6/1984 | Bollani |

(Continued)

FOREIGN PATENT DOCUMENTS

| | | |
|---|---|---|
| SU | 245004 | 11/1969 |
| SU | 1263203 A3 | 7/1986 |
| WO | WO 00/34577 | 6/2000 |

OTHER PUBLICATIONS

International Search Report and Written Opinion issued May 15, 2014 in corresponding International Application No. PCT/US2014/017320 (6 pages).

*Primary Examiner* — Mark Halpern
(74) *Attorney, Agent, or Firm* — Laura L. Bozek

(57) ABSTRACT

The disclosure relates to a method for trimming unwanted edges from a moving paper web. The disclosure also relates to the trimming of unwanted edges while the web is traveling on a structured papermaking fabric. The method uses a water nozzle having a diameter of 0.02" or less. The method also includes the removal of the unwanted edge trimmings to a trim chute through the use of moving air, for example, an air knife. The disclosure also relates to an edge trimming apparatus.

4 Claims, 5 Drawing Sheets

(56) References Cited

U.S. PATENT DOCUMENTS

| | | | | |
|---|---|---|---|---|
| 4,501,643 | A | 2/1985 | Kiuru | |
| 4,708,275 | A | 11/1987 | Farrell | |
| 4,931,140 | A | 6/1990 | Peltola et al. | |
| 5,028,300 | A | 7/1991 | Hollberg et al. | |
| 5,423,947 | A | 6/1995 | Steiner et al. | |
| 5,507,916 | A | 4/1996 | Schiel | |
| 5,512,136 | A | 4/1996 | Altug et al. | |
| 5,571,381 | A | 11/1996 | Vessari et al. | |
| 6,001,219 | A | 12/1999 | Caspar | |
| 6,021,699 | A | 2/2000 | Caspar | |
| 6,159,882 | A | 12/2000 | Kean et al. | |
| 6,207,016 | B1 | 3/2001 | Ekstrom | |
| 6,210,534 | B1 | 4/2001 | Graf | |
| 6,277,244 | B1 | 8/2001 | Meschenmoser | |
| 6,305,920 | B1 | 10/2001 | Kean et al. | |
| 6,319,364 | B1 | 11/2001 | Ekstrom | |
| 6,327,948 | B1 | 12/2001 | Tuori | |
| 6,475,315 | B1 | 11/2002 | Kean et al. | |
| 6,482,294 | B2 | 11/2002 | Meschenmoser | |
| 6,533,900 | B2 | 3/2003 | Puustinen et al. | |
| 6,681,670 | B2 | 1/2004 | Caspar et al. | |
| 6,834,849 | B2 * | 12/2004 | Hendle et al. | 270/21.1 |
| 6,841,043 | B2 | 1/2005 | Devoe et al. | |
| 6,942,758 | B2 * | 9/2005 | Juppi et al. | 162/193 |
| 6,955,107 | B2 | 10/2005 | Alitalo et al. | |
| 6,994,773 | B2 | 2/2006 | Beisswanger et al. | |
| 7,005,036 | B2 | 2/2006 | Beisswanger et al. | |
| 7,005,037 | B2 | 2/2006 | Weigant | |
| 8,029,646 | B2 | 10/2011 | Moncla et al. | |
| 2013/0220564 | A1 | 8/2013 | Michaud | |

* cited by examiner

SHEET EDGE TRIMMING AND REMOVAL FROM A STRUCTURED PAPER FABRIC

This application claims benefit under 35 U.S.C. §119 to U.S. Provisional Patent Application No. 61/785,284, filed Mar. 14, 2013, and to U.S. Provisional Patent Application No. 61,789,747, filed Mar. 15, 2013, both of which are incorporated herein in their entirety.

This disclosure relates to edge trimming equipment and methods for trimming unwanted edges from a moving paper web or board. This disclosure further relates to edge trimming that is carried out on a structured papermaking fabric, for example, a transfer fabric, a dryer fabric, or a roll. Still further, this disclosure relates to edge trimming equipment and a method for continuous trimming of a moving web in a paper machine using a water jet which minimizes rewet. This disclosure also relates to an edge trimming system that includes air separation of the unwanted trim from the remainder of the web, allowing the trim to be captured and reused in the process.

More particularly, the edge trimming system of the present invention allows for the regulation of sheet width over a range of operating conditions on a paper machine that may cause width variation. In one embodiment, the disclosure relates to a method for trimming an unwanted edge from a moving paper web by 1) making a trim cut in the paper web when it is on a structured papermaking fabric in the drying section of the paper machine; 2) removing the unwanted section of edge trim from the fabric before the pressure roll; and 3) guiding the excess trim to the Yankee pulper for reprocessing.

In another embodiment, this disclosure relates to an apparatus for trimming an unwanted edge from a moving paper web including a water nozzle for cutting the web; an air ejection system for removing the unwanted trim from the remainder of the web; and, a trim conveyor for guiding the unwanted trim away from the papermaking machine.

In papermaking processes, water jets are commonly used to cut through the traveling web. Water jets have been used in leader-cutting, edge trimming, slicing, cross-cutting and tail-cutting operations during the papermaking process. Low pressure water jets have been used in the wet-end of the process allowing the cutting of the web against the forming wire. Low pressure cutting works in the wet-end of the papermaking process because the consistency of the web is low in the wet-end making it easier to cut. As the solids content, i.e., consistency of the web increases, it is necessary to use higher pressure water jets to achieve appropriate cuts. If the pressure is too low, the cut will end up ragged and irregular. Processes for cutting the web in the dryer section, where the solids content is necessarily higher, have been contemplated. However, the nozzle size has traditionally been large to assure an adequately sized cut in the web. With these larger nozzles at high pressures, cutting the web against a papermaking fabric would damage the fabric, so most methods have used an integral web support structure against which the web can be cut. One method of the prior art has considered using high pressure water jets for leader or tail cutting against parts of the papermaking machine. This method was used only against a cylinder, Vac-roll, paper guide roll or in free draw, not against a structured fabric. Finally, water jets have heretofore been paired with collection chutes in edge trimming operations to remove the unwanted trim.

Processes and the apparatus of the present invention differ from these prior processes in one or more of the following respects. The process as disclosed herein uses a nozzle having a diameter of less than about 0.02." Such a nozzle provides for precise cutting of the edge without the concomitant introduction of too much water into the web. Further, the small nozzle does not cause a significant amount of fiber from the traveling web to be embedded in the structured papermaking fabric allowing the process to run more cleanly. Still further, this small nozzle allows the edge to be trimmed away against the structured papermaking fabric without damaging the fabric. The process includes the removal of the unwanted trim by an air ejector proximate the cutting nozzle. Since the cut made by this small nozzle is itself small, the cut can re-fuse, making the unwanted edge impossible to remove, unless it is removed by an air ejection system. Finally, the process of the invention uses the air ejection system to move the trim to a trim conveyor for movement away from the papermaking machine.

DESCRIPTION

Figure 1:
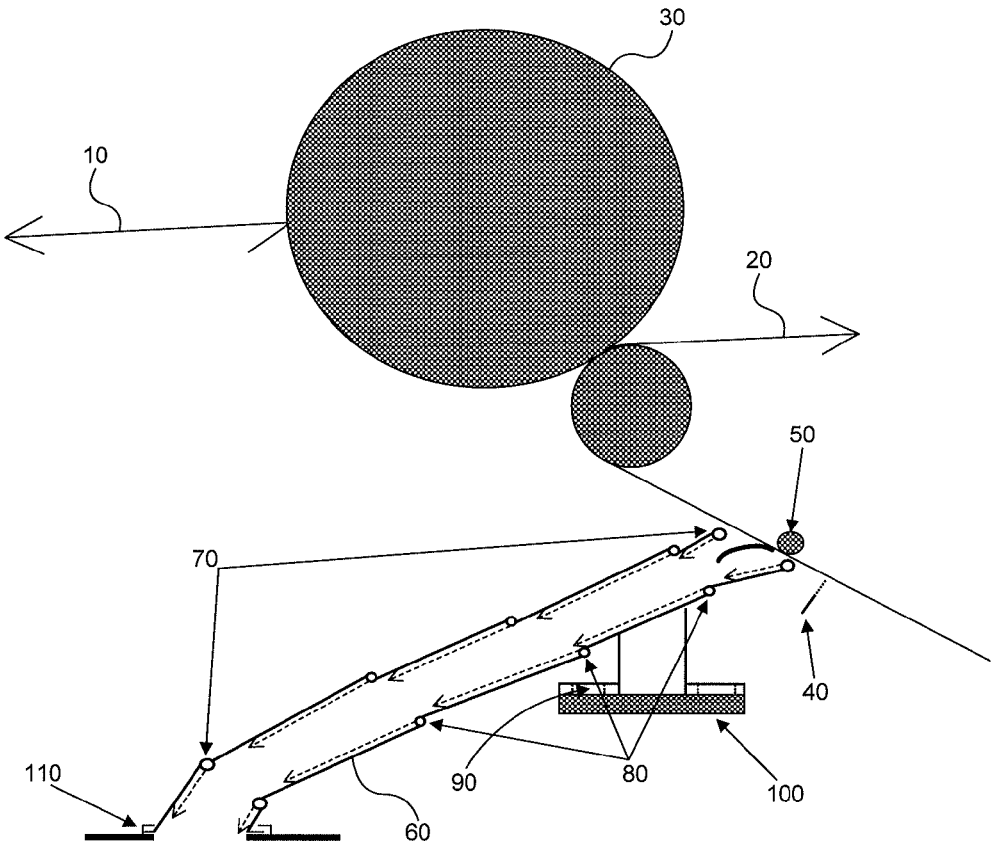
FIG. 1 is a schematic representation of the edge trimming process as disclosed.

The present disclosure describes a method and apparatus for trimming the unwanted edge from a moving paper web while that web is being carried through the drying section of a paper machine on a structured drying fabric, e.g., a through air drying (TAD) fabric, a transfer fabric, an after-dryer fabric, or a belted roll winding fabric.

As used herein, the terms "trim" and "unwanted edge" both refer to the section of the moving paper web that will be cut away and will not form a part of the final paper roll. This unwanted material is generally returned to the process for repulping and reuse.

As used herein the term "web" and "sheet" are used interchangeably to refer to the moving paper that is produced during the papermaking process.

As used herein the terms "apparatus," "system" and "assembly" are used interchangeably and refer to one or more mechanical structure that performs the described function.

The paper web that may be trimmed using the method and system of the present disclosure can have a sheet consistency of anywhere between about 28% and about 90%.

The moving paper web may be produced by any art recognized method, that uses a structured papermaking fabric in its drying section. The method for making the paper web may include a Yankee dryer or it may not, for example, TAD. In process using a Yankee dryer, the edge trim will generally occur on the transfer fabric to the Yankee, before the pressure roll. In a TAD process, the edge will likely be trimmed on the wire or on the dry-end of the paper machine.

The water nozzles used to produce the cuts in the paper web are very small. Each water nozzle is typically less than about 0.02" in diameter, such as less than about 0.01" in diameter, such as from about 0.005" to about 0.008" in diameter. The water supplied by the nozzles may be at ambient temperature, may be heated, or may be superheated. In one embodiment, the water used with such small nozzles may be subject to strict filtration requirements. In another embodiment, the water used with such small nozzles may need to be softened. In yet another embodiment, the water may be both softened and filtered.

The nozzle can be angled within about 45° in the clockwise or counterclockwise directions. In one embodiment, the nozzle is angled up to about 10° in either direction. In another embodiment, the nozzle is angled up to about 5° in either direction.

The water is applied at a pressure of form about 0 psig to about 1500 psig, such as from about 700 psig to about 1200 psig.

The nozzle assembly may include one or more shower assemblies. In one embodiment, the nozzle assembly includes 4 shower assemblies. In another embodiment the nozzle assembly includes 3 shower assemblies, In still another embodiment, the nozzle assembly includes 2 shower assemblies According to one embodiment, the shower assemblies include an inline pressure gauge positioned before the nozzle. In one embodiment, the nozzle assembly includes one or more flow/pressure control valves allowing for pressure control at each nozzle. In another embodiment, the nozzle assembly includes one or more ruby nozzles with an orifice of less than about 0.02". In another embodiment, the shower assembly further includes an inline strainer capable of filtering contaminants as small as about 3 microns. In another embodiment, the shower assembly includes an adjustment and lockdown mechanism allowing for quick adjustment for cross-machine direction positioning and alteration of the nozzle angle. According to another embodiment, the shower assemblies may include a quick disconnect allowing for rapid changing of nozzles. According to another embodiment each nozzle may be adjusted independently. In one embodiment the nozzles may each be adjusted in a 360° rotation. According to one embodiment, the nozzles are oriented toward the outside of the web in the cross direction. In another embodiment, the nozzles may be oriented against the run in the machine direction at an angle between about 5° and about 15°. In another embodiment the entire nozzle block may be moved together.

The distance between the nozzle and the moving paper web is about 6 inches or less, preferably about 4" or less. The upper limit for moving the nozzle away from the paper web is when the water jet breaks up and is no longer effective.

In one embodiment, the nozzle assembly includes at least two shower assemblies that are offset from one another in the machine direction. The arrangement allows the nozzles to make two cuts which can define a smaller unwanted trim portion. This smaller unwanted trim is generally located between the moving web and the remaining unwanted trim. In this embodiment, the smaller unwanted trim portion can be removed proximate the web cutting while the remaining unwanted trim can continue in the process to be removed later, for example from the Yankee dryer. This embodiment will be discussed below in reference to FIG. 6.

Following the cutting of the web the unwanted trim is removed from the structured papermaking fabric. Any art recognized method for removal can be used. In one embodiment, the removal is done by an air ejection system proximal the cut between about 2" and about 4". In one embodiment, the air ejection system and the cutting nozzle are carried on a master assembly to maintain their relative position despite repositioning the cutting nozzles. Air ejection systems that can be used in the present disclosure include air knives and blow-off pipes. In one embodiment, the air ejection system is on the opposite side of the structured paper fabric from the cutting nozzle. The rate of re-fusion of the cut web will depend to some extent upon the weight of the paper web, and the amount of residual water in the paper web at the time of cutting. The skilled artisan, based upon the paper to be cut, can determine an appropriate proximity for the air ejection system.

The pressure of the air is between about 0 psig and about 80 psig, such as between about 20 psig and about 70 psig. The air pressure is adjusted in response to the behavior and direction of the unwanted piece of trim.

The air ejection system can be angled within about 25° in the clockwise or counterclockwise directions. In one embodiment, the air ejection system is angled up to about 10° in either direction. In another embodiment, the air ejection system is angled up to about 5° in either direction.

The unwanted trim is blown by the air ejection system into a collection apparatus. In one embodiment, the air ejection system is positioned even with the start of the collection apparatus. Any art recognized collection apparatus or trim chute may be used in the present invention. In one embodiment, the collection apparatus is less than about 6" from the structured papermaking fabric, such as less than about 5".

According to one embodiment, the unwanted trim is collected in a trim chute that has been equipped with an air shower to assist in moving the unwanted material down the chute. According to another embodiment, the chute further includes water showers that also assist the movement of the unwanted trim through the system and preferably to a repulper. According to another embodiment, the chute further uses vacuum. According to one embodiment, the vacuum in the chute is drawn by the compressed air that is driven through the chute. According to another embodiment, the vacuum is applied via a vacuum source. The method and the apparatus will not be described more fully in view of the figures, which are exemplary only.

The method and apparatus for trimming an unwanted edge from a traveling paper web is schematically represented in FIG. 1. A paper web 10 is carried on a structured papermaking transfer fabric 20 toward a Yankee dryer 30. One or more unwanted edges are cut via nozzle 40. An air ejection system 50 blows the unwanted trimmed edge to the trim chute 60. The unwanted trim is carried along the chute by air showers 70 and water showers 80. The chute carries the unwanted trim to the pulper 110. The chute may be adjusted horizontally via the bar 100. The chute may be adjusted in the machine direction via the slotted brackets 90.

Figure 2:
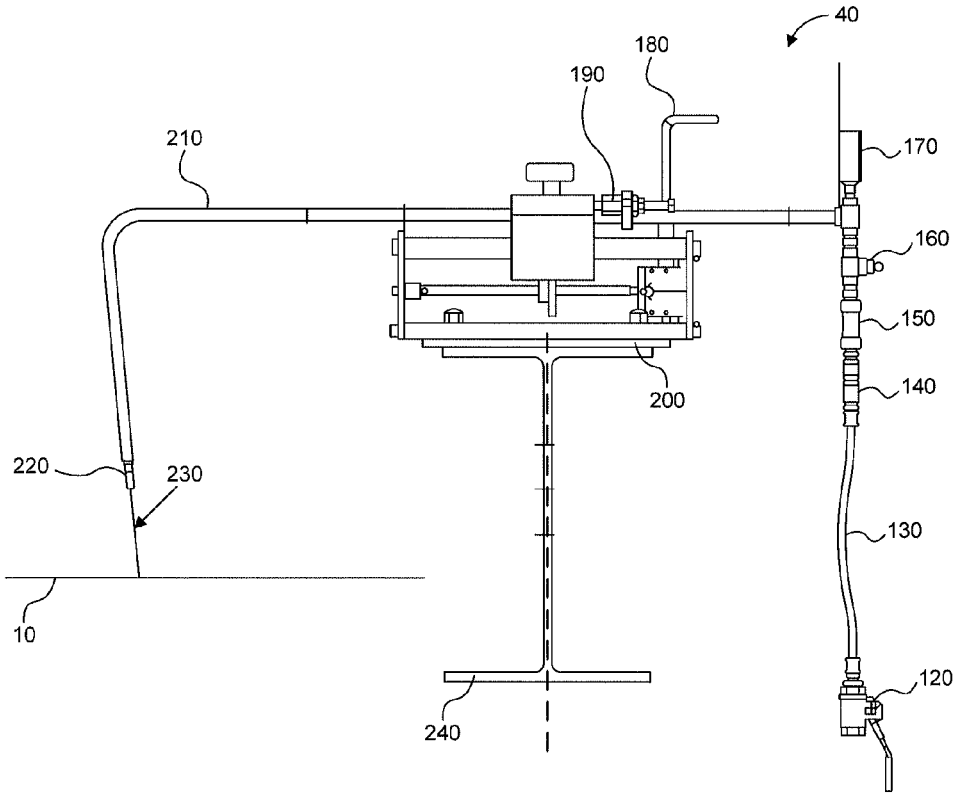
FIG. 2 is side plan view of a nozzle assembly as disclosed.

According to one embodiment a nozzle assembly 40 of FIG. 2 of the invention is attached to a papermaking machine 240 via sub-plate 200. The paper web 10 traveling in the machine direction passes under the nozzle assembly 40 contacting the water stream 230 which is generated by nozzle 220. The water stream 230 cuts the paper web 10 allowing an unwanted edge to be removed by an air ejection system 50, not shown. The nozzle 220 is fed via pipe 210 which contains fluid under pressure. The pressurized fluid is supplied through ball valve 120 and is filtered via filter 150 before being regulated via pressure gauge 170. Should the nozzle 220 need to be repaired or cleaned, quick-connect 140 may be released. The placement of the nozzle 220 relative to the moving paper web 10 may be adjusted by crank 180 or by micro adjuster 190 to adjust the placement of the corresponding cut.

Figure 3:
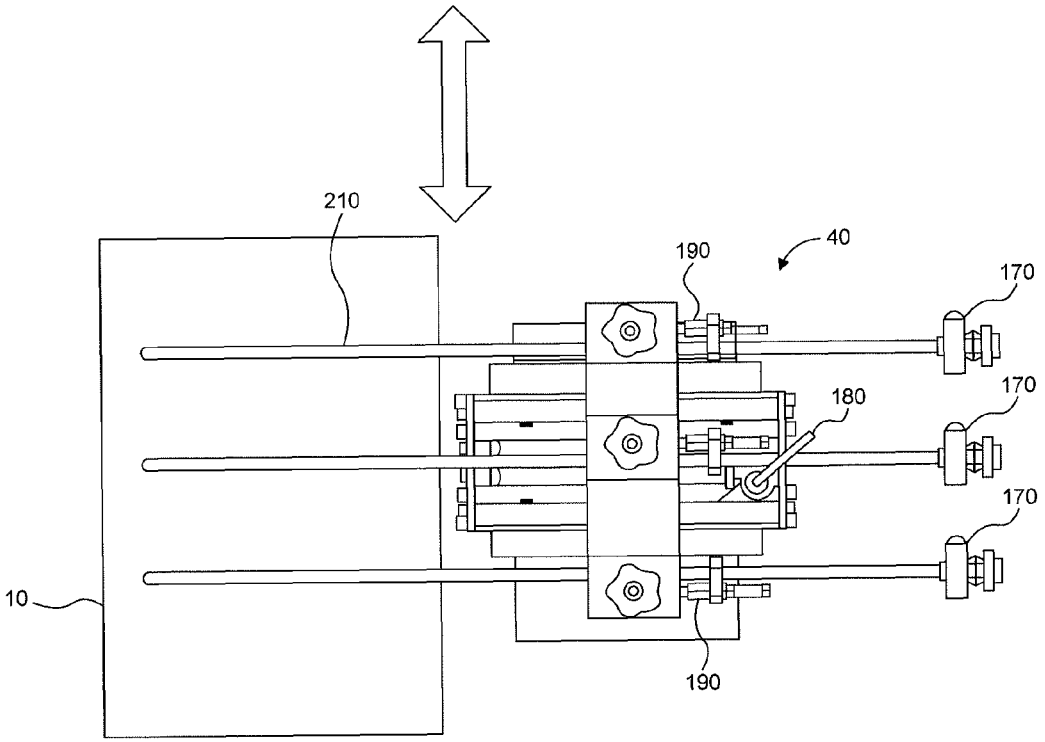
FIG. 3 is a top plan view of a three nozzle assembly.
Figure 4:
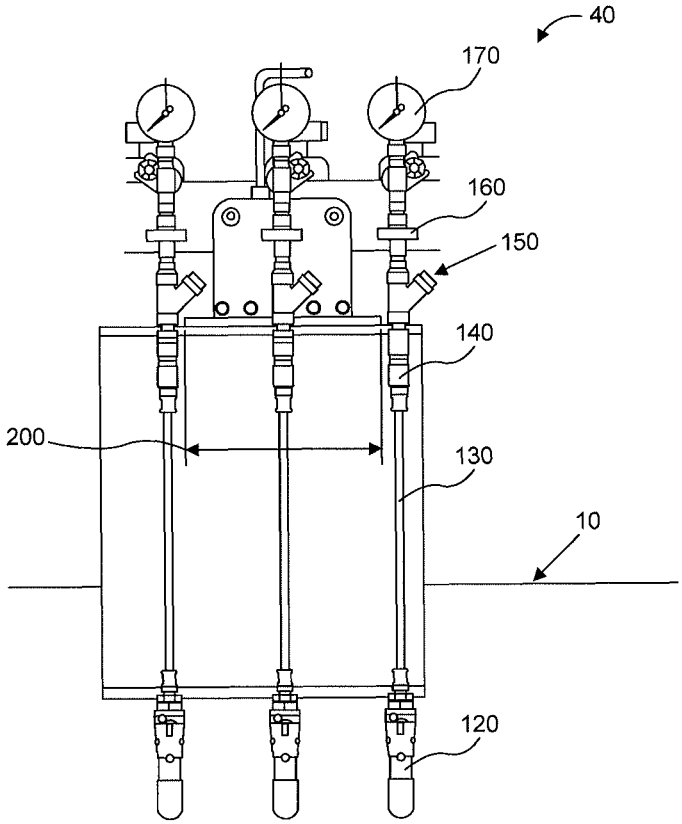
FIG. 4 is a side plan view of a three nozzle assembly.

A multi-nozzle assembly 40 having three nozzles can be seen in FIGS. 3 and 4. As with the single nozzle assembly each nozzle includes a shower assembly as seen in FIGS. 2 and 4. The placement of the three nozzles can be adjusted independently. As can be seen in FIG. 4, the shower assembly may include a conduit 130 between the ball valve 120 and the quick-connect 140. The conduit may be any art recognized material. In one embodiment, the conduit is a flexible material. Also seen in FIG. 4 is a needle value 160 for adjusting the pressure in the line.

As used herein, "about" is meant to account for variations due to experimental error. All measurements are understood to be modified by the word "about", whether or not "about" is explicitly recited, unless specifically stated otherwise. Thus, for example, the statement "a nozzle of less than 0.02 inches" is understood to mean "a nozzle of less than about 0.02 inches."

The details of one or more non-limiting embodiments of the invention are set forth in the examples below. Other embodiments of the invention should be apparent to those of ordinary skill in the art after consideration of the present disclosure.

EXAMPLES

Example 1

A moving paper web, traveling in the machine direction of a paper machine and riding on a transfer fabric, was subjected to edge trimming according to the invention. The moving paper web was passed beneath a shower assembly have a single nozzle of 0.008" in diameter. In one case, the work was done on a multi-nozzle assembly using a single nozzle. In a second case, the work was done on a multi-nozzle assembly using multiple nozzles. The water issuing from the nozzle cut the paper web at a position between an unwanted edge portion and a sheet portion. The water was 120° F. and each nozzle was 700 psig.

Figure 5:
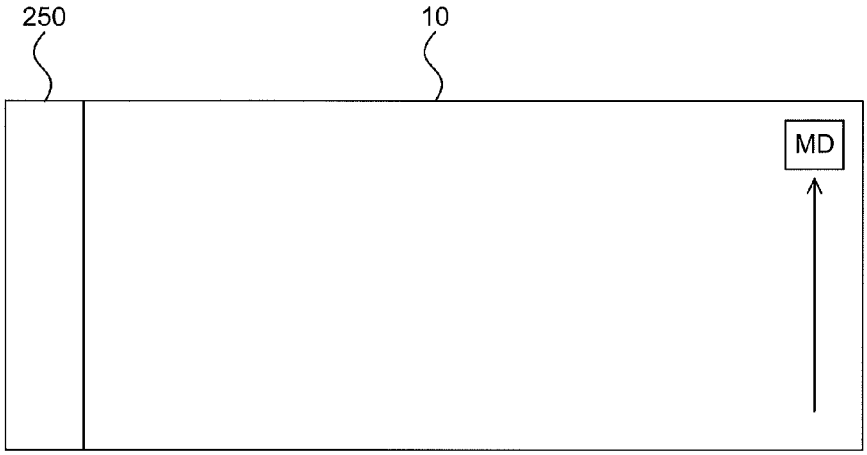
FIG. 5 is a schematic of one embodiment of the invention using a single edge cut.

The unwanted edge portion was removed from the transfer fabric surface by an air knife that was located 2" forward of the cutting position. This is schematically represented in FIG. 5. The web 10 moving in the machine direction was cut by the water jet to leave an unwanted edge portion 250. The unwanted edge portion 250 was removed by a blow pipe (not shown).

Example 2

Figure 6:
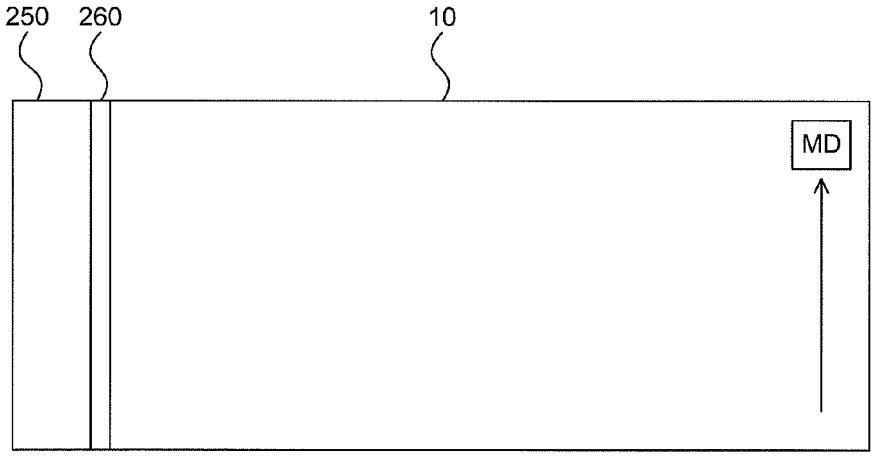
FIG. 6 is a schematic of one embodiment of the invention using a double edge cut.

A moving paper web, traveling in the machine direction of a paper machine and riding on a transfer fabric, was subjected to edge trimming according to the invention. The moving paper web was passed beneath a shower assembly have multiple nozzles of 0.008" in diameter and offset from one another in the cross machine direction. The water issuing from the nozzles made two cuts in the paper web at a position between an unwanted edge portion and a sheet portion. The water was 120° F. and each nozzle was 700 psig. Only unwanted edge portion sandwiched between the sheet and the remaining trim was removed from the transfer fabric surface by a blow pipe that was located 2" forward of the cutting position. This is schematically represented in FIG. 6. The web 10 moving in the machine direction was cut twice by the water jets to leave an unwanted edge portion 250 and an intermediate portion 260. Only intermediate portion 260 was removed by a blow pipe (not shown). Remaining edge portion 250 was carried along on the structured transfer fabric with web 10 and was removed at the Yankee dryer and returned to the process for repulping and reuse.

A number of embodiments have been described. Nevertheless, it will be understood that various modifications may be made without departing from the spirit and scope of the disclosure. Accordingly, other embodiments are within the scope of the following claims.

We claim:

1. An apparatus for trimming an unwanted edge from a moving paper web comprising:

a water nozzle, located on a papermaking machine, having a diameter of less than about 0.02" for cutting unwanted trim from a paper web traveling in a machine direction;

an air ejection system, subsequently located on the papermaking machine with respect to the water nozzle in the machine direction, for removing the unwanted trim from the remainder of the web;

and, a collection apparatus, adjacent to or subsequently located on the papermaking machine with respect to the air ejection system in the machine direction, for guiding the unwanted trim away from the papermaking machine.

2. The apparatus of claim 1, wherein the water nozzle and air ejection system are located on a master assembly.

3. The apparatus of claim 1, wherein the collection apparatus is a trim chute.

4. The apparatus of claim 1, wherein the nozzle diameter is less than 0.01".

* * * * *